US007921794B1

(12) United States Patent
Cullom et al.

(10) Patent No.: US 7,921,794 B1
(45) Date of Patent: Apr. 12, 2011

(54) SHALLOW WATER ANCHOR SYSTEM

(76) Inventors: Edward N. Cullom, New Port Richey, FL (US); Susan Cullom, Boynton Beach, FL (US)

( * ) Notice: Subject to any disclaimer, the term of this patent is extended or adjusted under 35 U.S.C. 154(b) by 415 days.

(21) Appl. No.: 12/148,077

(22) Filed: Apr. 16, 2008

(51) Int. Cl.
*B63B 21/24* (2006.01)

(52) U.S. Cl. ..... 114/294; 114/295

(58) Field of Classification Search ..... 440/6; 114/285, 114/294, 295
See application file for complete search history.

(56) References Cited

U.S. PATENT DOCUMENTS

| | | | | |
|---|---|---|---|---|
| 3,159,131 | A * | 12/1964 | Frederick | 114/285 |
| 3,980,039 | A * | 9/1976 | Henning | 440/6 |
| 4,254,730 | A * | 3/1981 | Crenshaw | 114/294 |
| 6,041,730 | A * | 3/2000 | Oliverio et al. | 114/294 |
| 6,092,484 | A * | 7/2000 | Babin et al. | 114/295 |
| 7,056,169 | B1 * | 6/2006 | Lokken et al. | 440/63 |
| 7,270,072 | B2 | 9/2007 | Waldrop | |

* cited by examiner

*Primary Examiner* — Stephen Avila

(57) ABSTRACT

A rod-shaped anchor has lower and upper ends and a central extent. A fixed plate and a movable plate with adjustment mechanisms couple the plates. The movable plate has an exterior end. A vertical collar slidably receives the central extent of the anchor. Driving mechanisms selectively raise and lower the anchor. A control assembly is operatively coupled with respect to the driving mechanisms.

6 Claims, 6 Drawing Sheets

20
22
2
60
48
62
3
44
36
34
30
38
46
64
66
3
14
12
16
24
26
28
18
2

FIG 2
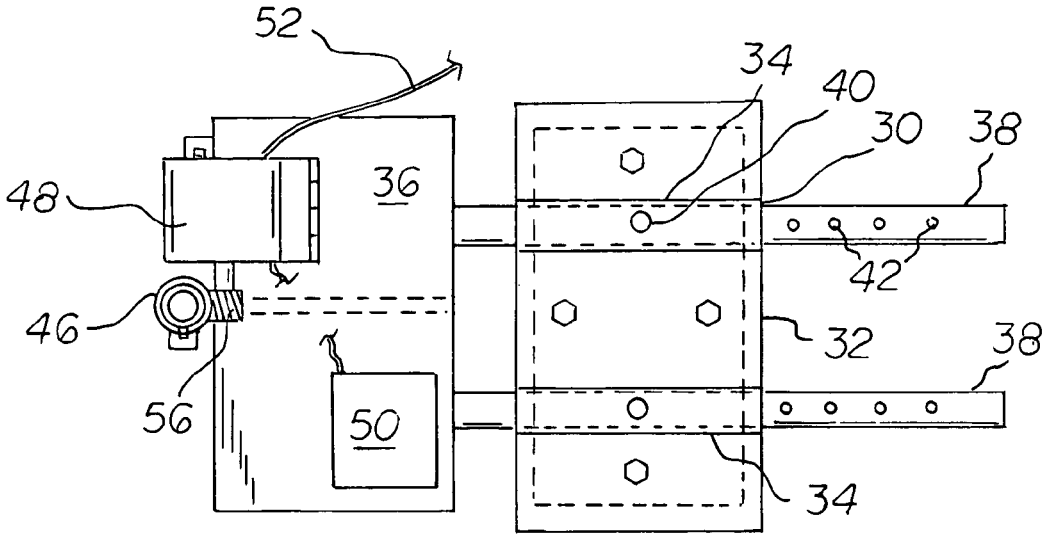
FIG 3
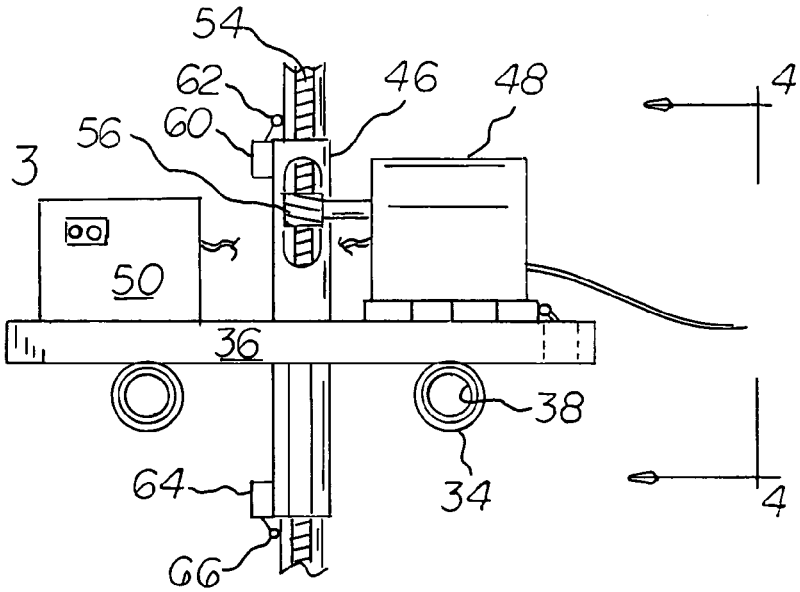
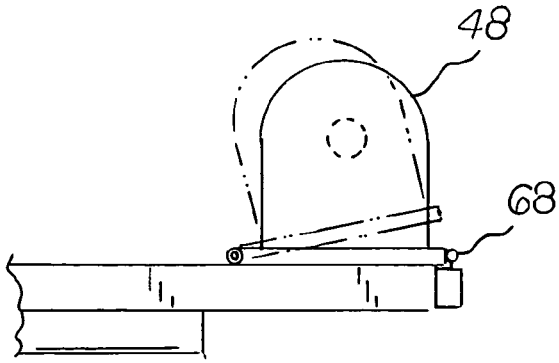
FIG 4

SHALLOW WATER ANCHOR SYSTEM

BACKGROUND OF THE INVENTION

1. Field of the Invention

The present invention relates to a shallow water anchor system and more particularly pertains to automatically moving a rod-shaped anchor between a lowered orientation for operation and use and a raised orientation for transportation and storage, all in a safe, convenient and economical manner.

2. Description of the Prior Art

The use of anchor systems of known designs and configurations is known in the prior art. More specifically, anchor systems of known designs and configurations previously devised and utilized for the purpose of securing the position of a boat through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,041,730 issued Mar. 28, 2000 to Oliverio relates to a Shallow Water Anchor and U.S. Pat. No. 7,270,072 issued Sep. 18, 2007 to Waldrop relates to a Florida Anchor.

While these devices fulfill their respective, particular objectives and requirements, the aforementioned patents do not describe a shallow water anchor system that allows for automatically moving a rod-shaped anchor between a lowered orientation for operation and use and a raised orientation for transportation and storage, all in a safe, convenient and economical manner.

In this respect, the shallow water anchor system according to the present invention substantially departs from the conventional concepts and designs of the prior art, and in doing so provides an apparatus primarily developed for the purpose of automatically moving a rod-shaped anchor between a lowered orientation for operation and use and a raised orientation for transportation and storage, all in a safe, convenient and economical manner.

Therefore, it can be appreciated that there exists a continuing need for a new and improved shallow water anchor system which can be used for automatically moving a rod-shaped anchor between a lowered orientation for operation and use and a raised orientation for transportation and storage, all in a safe, convenient and economical manner. In this regard, the present invention substantially fulfills this need.

SUMMARY OF THE INVENTION

In view of the foregoing disadvantages inherent in the known types of anchor systems of known designs and configurations now present in the prior art, the present invention provides an improved shallow water anchor system. As such, the general purpose of the present invention, which will be described subsequently in greater detail, is to provide a new and improved shallow water anchor system and method which has all the advantages of the prior art and none of the disadvantages.

To attain this, the present invention essentially comprises a shallow water anchor system. First provided is a boat. The boat has a periphery with a horizontal support surface.

A rod-shaped anchor is provided. The anchor has a pointed lower end. The lower end is provided below. The anchor has a free upper end. The upper end is provided above. The anchor has a cylindrically shaped central extent. The central extent is provided between the upper and lower ends. The lower end has threads. The lower end has a replaceable point. The replaceable point has receiving threads. In this manner the replacement of the point as a function of the surface being penetrated by the anchor is allowed.

Provided next is an adjustable coupling assembly. The coupling assembly is provided between the support surface and the central extent of the anchor. The coupling assembly includes a fixed plate. Bolts are provided. The bolts attach the fixed plate to the support surface. The fixed plate has parallel horizontal tubes. The coupling assembly also includes a movable plate. The movable plate has an interior end. The movable plate has parallel horizontal rods. The horizontal rods are reciprocable within the tubes. The movable plate has apertures. The apertures are provided through the rods and tubes. The movable plate has pins. The pins are provided through the apertures. In this manner the movable plate may be fixedly positioned with respect to the fixed plate and the boat. The movable plate has an exterior end. The exterior end has a vertical collar. The vertical collar slidably receives the central extent of the anchor. In this manner the anchor may be moved between raised and lowered orientations. The collar has an upper end and a lower end.

Driving mechanisms selectively raise and lower the anchor. The driving mechanisms include a motor. The motor is pivotably mounted on the movable plate. The driving mechanisms include a battery. The battery powers the motor. The driving mechanisms include a line to a hand held controller. The line controls the motor. The central extent of the anchor has a linear gear. The motor has a rotatable worm gear. The worm gear is co-operable with the linear gear. In this manner powering the motor and rotating the worm gear in a first direction will raise the linear gear and anchor. Also in this manner powering the motor and rotating the worm gear in a second direction will lower the linear gear and anchor.

The control assembly is operatively coupled with the motor. The coupling assembly includes an upper limit switch. The upper limit switch is secured to the upper end of the collar. The upper limit switch has an upper finger. The upper finger is normally in contact with the anchor. In this manner a circuit is closed to the motor. The upper finger is adapted to switch when the upper end of the anchor passes below the finger. In this manner the motor may be stopped. Further in this manner the anchor may be precluded from passing beyond the collar. The coupling assembly includes a lower limit switch. The lower limit switch is secured to the lower end of the collar. The lower limit switch has a lower finger. The lower finger is normally in contact with the anchor. In this manner a circuit is closed to the motor. The lower finger is adapted to switch when the lower end of the anchor passes above the lower finger. In this manner the motor may be stopped. Further in this manner the anchor may be precluded from passing above the collar. The coupling assembly includes a supplemental switch. The supplemental switch is secured between the motor and the movable plate. In this manner a circuit is closed to the motor. The supplemental switch is adapted to open when the lower end of the anchor hits a rigid surface with the motor running. In this manner the motor is effectively lifted and the switch opened for stopping the motor.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shallow water anchor system which has all of the advantages of the prior art anchor systems of known designs and configurations and none of the disadvantages.

It is another object of the present invention to provide a new and improved shallow water anchor system which may be easily and efficiently manufactured and marketed.

It is further object of the present invention to provide a new and improved shallow water anchor system which is of durable and reliable constructions.

An even further object of the present invention is to provide a new and improved shallow water anchor system which is susceptible of a low cost of manufacture with regard to both materials and labor, and which accordingly is then susceptible of low prices of sale to the consuming public, thereby making such shallow water anchor system economically available to the buying public.

Even still another object of the present invention is to provide a shallow water anchor system for automatically moving a rod-shaped anchor between a lowered orientation for operation and use and a raised orientation for transportation and storage, all in a safe, convenient and economical manner.

Lastly, it is an object of the present invention to provide a new and improved shallow water anchor system. A rod-shaped anchor has lower and upper ends and a central extent. A fixed plate and a movable plate with adjustment mechanisms couple the plates. The movable plate has an exterior end. A vertical collar slidably receives the central extent of the anchor. Driving mechanisms selectively raise and lower the anchor. A control assembly is operatively coupled with respect to the driving mechanisms.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross sectional view taken along line 2-2 of FIG. 1.

FIG. 3 is a cross sectional view taken along line 3-3 of FIG. 1.

FIG. 4 is a side elevational view taken along line 4-4 of FIG. 3.

The same reference numerals refer to the same parts throughout the various Figures.

DESCRIPTION OF THE PREFERRED EMBODIMENT

Figure 1:
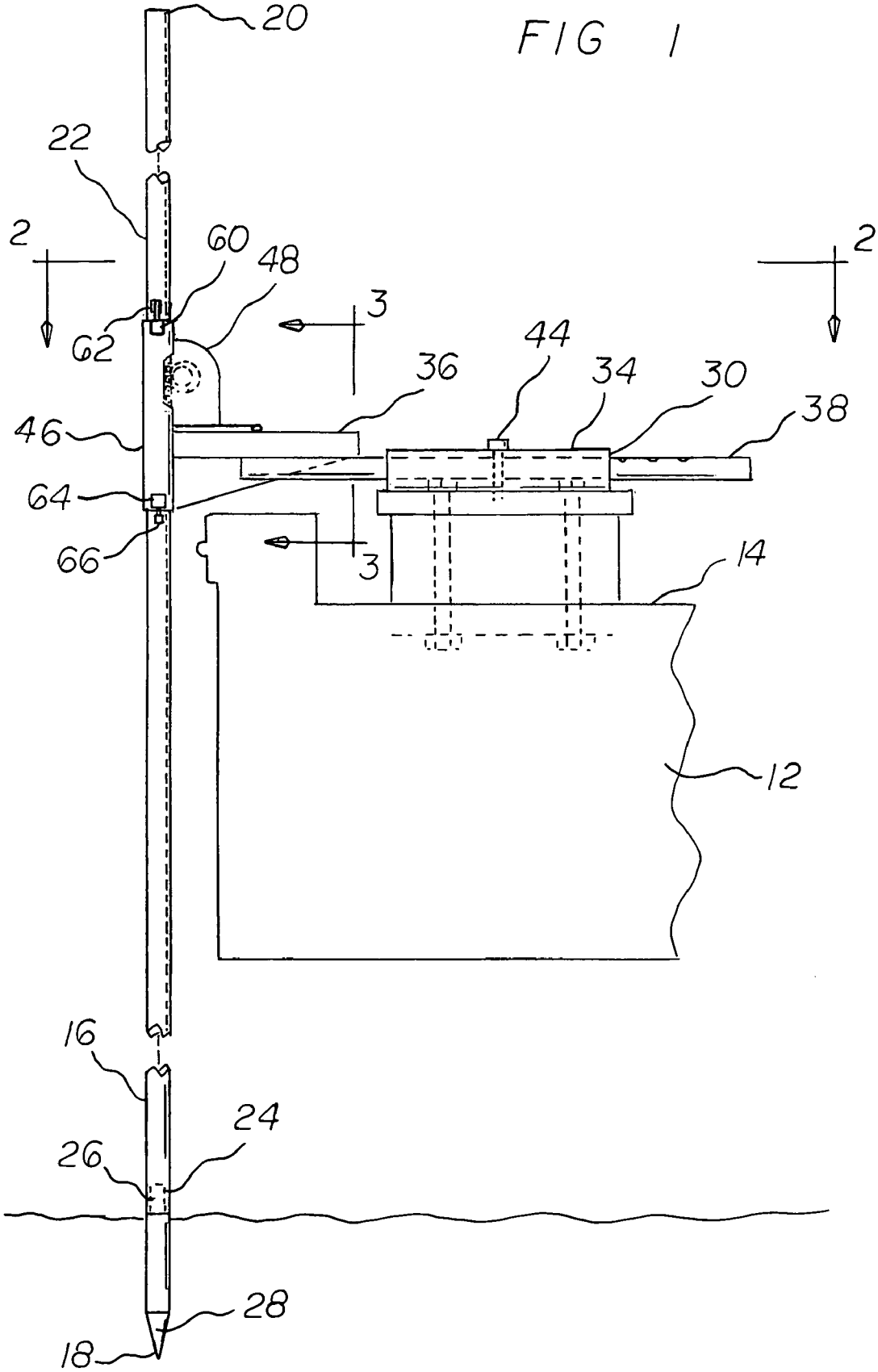
FIG. 1 is a side elevational view of a shallow water anchor system constructed in accordance with the principles of the present invention.

With reference now to the drawings, and in particular to FIG. 1 thereof, the preferred embodiment of the new and improved shallow water anchor system embodying the principles and concepts of the present invention and generally designated by the reference numeral 10 will be described.

The present invention, the shallow water anchor system 10 is comprised of a plurality of components. Such components in their broadest context include a rod-shaped anchor, a fixed plate, a movable plate, driving mechanisms and a control assembly. Such components are individually configured and correlated with respect to each other so as to attain the desired objective.

First provided is a boat 12. The boat has a periphery with a horizontal support surface 14.

A rod-shaped anchor 16 is provided. The anchor has a pointed lower end 18. The lower end is provided below. The anchor has a free upper end 20. The upper end is provided above. The anchor has a cylindrically shaped central extent 22. The central extent is provided between the upper and lower ends. The lower end has threads 24. The lower end has a replaceable point 28. The replaceable point has receiving threads 26. In this manner the replacement of the point as a function of the surface being penetrated by the anchor is allowed.

Provided next is an adjustable coupling assembly 30. The coupling assembly is provided between the support surface and the central extent of the anchor. The coupling assembly includes a fixed plate 32. Bolts are provided. The bolts attach the fixed plate to the support surface. The fixed plate has parallel horizontal tubes 34. The coupling assembly also includes a movable plate 36. The movable plate has an interior end. The movable plate has parallel horizontal rods 38. The horizontal rods are reciprocable within the tubes. The movable plate has apertures 40, 42. The apertures are provided through the rods and tubes. The movable plate has pins 44. The pins are provided through the apertures. In this manner the movable plate may be fixedly positioned with respect to the fixed plate and the boat. The movable plate has an exterior end. The exterior end has a vertical collar 46. The vertical collar slidably receives the central extent of the anchor. In this manner the anchor may be moved between raised and lowered orientations. The collar has an upper end and a lower end.

Driving mechanisms selectively raise and lower the anchor. The driving mechanisms include a motor 48. The motor is pivotably mounted on the movable plate. The driving mechanisms include a battery 50. The battery powers the motor. The battery is adapted to be a standard battery or a rechargeable battery. Power may thus be provided by direct current as through a battery or by alternating current through any of a plurality of power sources, hardwired or otherwise. The driving mechanisms include a line 52 to a hand held controller. The line controls the motor. The central extent of the anchor has a linear gear 54. The motor has a rotatable worm gear 56. The worm gear is co-operable with the linear gear. In this manner powering the motor and rotating the worm gear in a first direction will raise the linear gear and anchor. Also in this manner powering the motor and rotating the worm gear in a second direction will lower the linear gear and anchor.

The control assembly is operatively coupled with the motor. The coupling assembly includes an upper limit switch 60. The upper limit switch is secured to the upper end of the collar. The upper limit switch has an upper finger 62. The upper finger is normally in contact with the anchor. In this manner a circuit is closed to the motor. The upper finger is adapted to switch when the upper end of the anchor passes below the finger. In this manner the motor may be stopped. Further in this manner the anchor may be precluded from passing beyond the collar. The coupling assembly includes a lower limit switch 64. The lower limit switch is secured to the lower end of the collar. The lower limit switch has a lower finger 66. The lower finger is normally in contact with the anchor. In this manner a circuit is closed to the motor. The lower finger is adapted to switch when the lower end of the anchor passes above the lower finger. In this manner the motor may be stopped. Further in this manner the anchor may be precluded from passing above the collar. The coupling assembly includes a supplemental switch 68. The supplemental switch is secured between the motor and the movable plate. In this manner a circuit is closed to the motor. The supplemental switch is adapted to open when the lower end of the anchor hits a rigid surface with the motor running. In this manner the motor is effectively lifted and the switch opened for stopping the motor.

Figure 5:
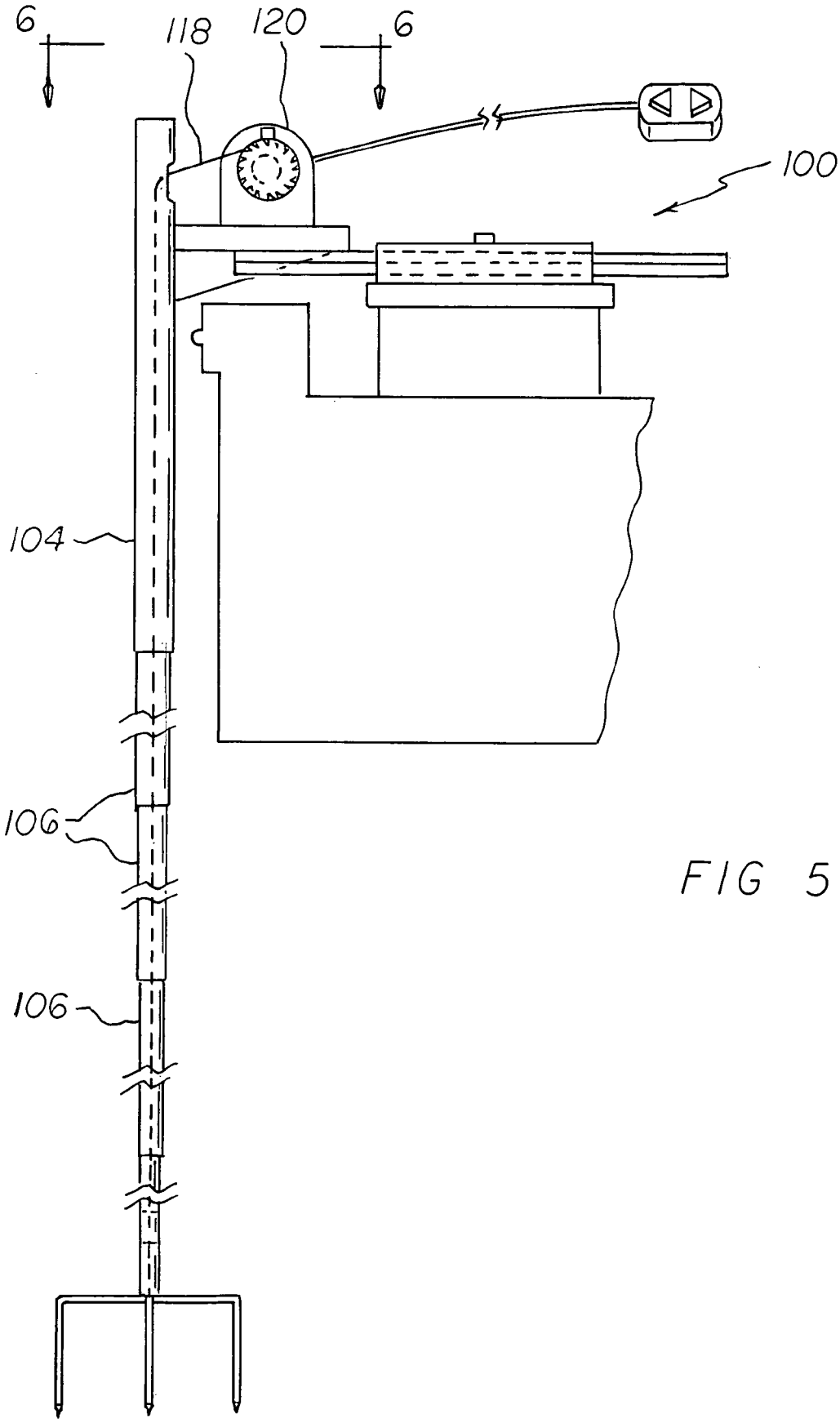
FIG. 5 is a side elevational view of a shallow water anchor system constructed in accordance with an alternate embodiment of the invention.
Figure 6:
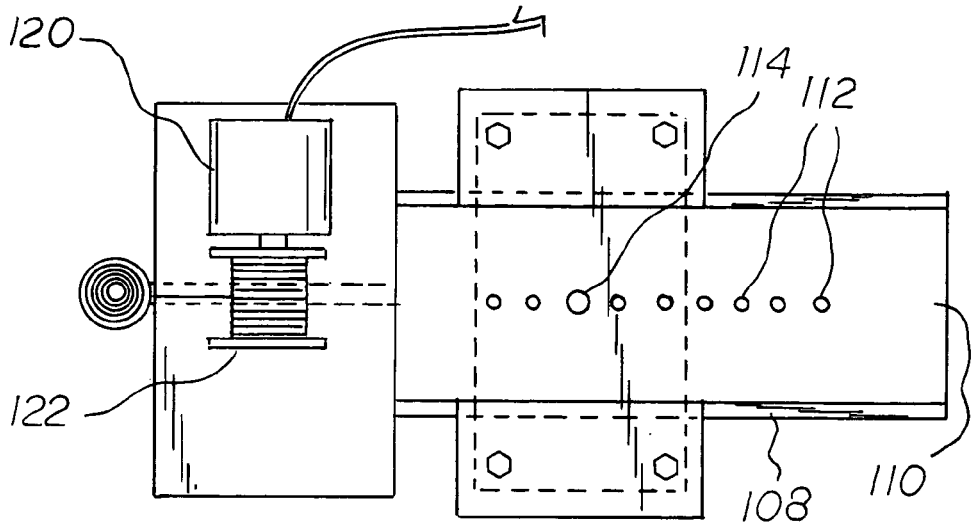
FIG. 6 is a plan view taken along line 6-6 of the FIG. 5 embodiment.
Figure 7:
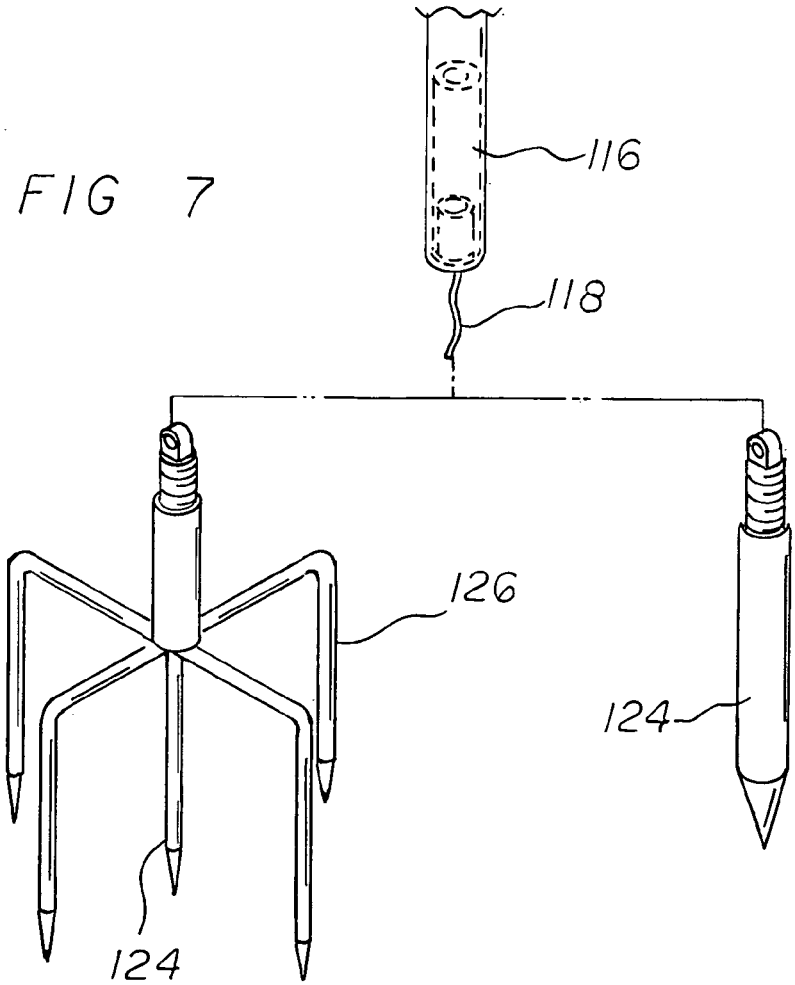
FIG. 7 is an exploded perspective illustration of the lower portion of the FIG. 5 embodiment.

Reference is now made to the embodiment of FIGS. 5, 6 and 7. An anchor 104 is provided. The anchor includes a plurality of stackable cylindrical sections 106. The stackable cylindrical sections are adapted to be contracted by stacking the sections and extended by unstacking the sections in a telescoping manner.

The adjustment mechanisms include an exterior channel member 108. The exterior channel member is secured to the fixed plate. The adjustment mechanisms include an interior plate member 110. The interior plate member is slidable in the channel member. Apertures 112, 114 are provided. The apertures are provided through the plate member and channel member. A pin is positionable through the apertures for securement purposes.

The driving mechanisms include a weight 116. The weight is provided in the lower end of the anchor. In this manner the anchor may be lowered. The driving mechanisms include a cable 118. In this manner the anchor may be raised. The cable include an operator controlled motor 120. The cable includes a spool 122. The cable has an upper end. The upper end is secured to the spool. The cable has a lower end. The lower end extends through the anchor. The lower end is attached adjacent to the lower end of the anchor. The motor and spool are adapted to wind up the cable. In this manner the anchor is lifted. The motor and spool are further adapted to pay out the cable. In this manner the anchor is lowered. Control is provided through the operator and the cable and motor.

The lower end of the anchor is threaded in place. The lowermost end is a pointed end. The pointed end is chosen from the class of pointed ends. The class of pointed ends includes a single point 124. The single point is provided coaxial with the anchor. The class of pointed ends includes a plurality of points 126. The plurality of points have axes offset from the axis of the anchor.

Figures 8, 9:
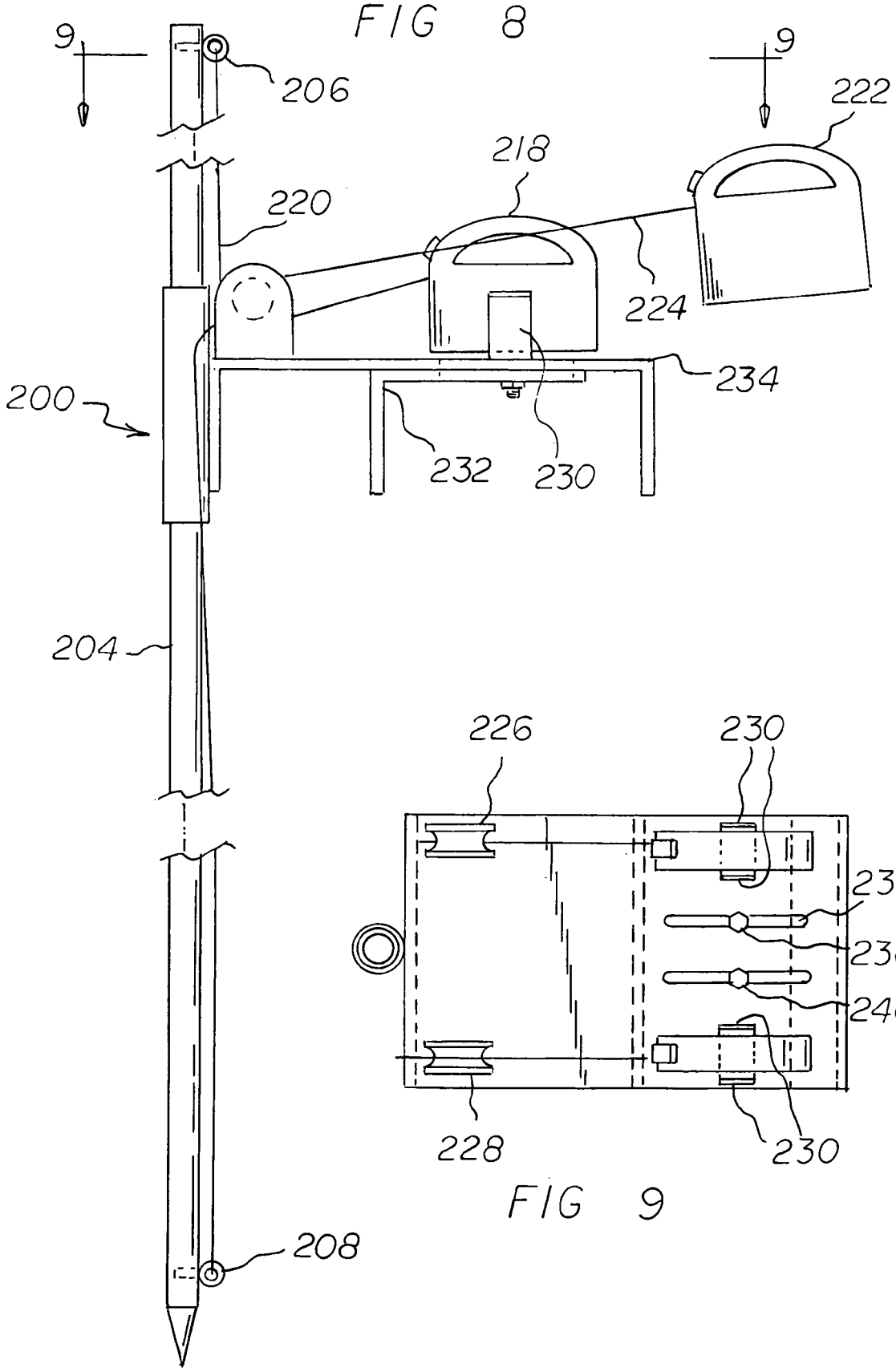
FIG. 8 is a side elevational view of a shallow water anchor system constructed in accordance with another alternate embodiment of the invention.
FIG. 9 is a plan view taken along line 9-9 of the FIG. 8 embodiment.

Reference is now made to the embodiment of FIGS. 8 and 9. An anchor 204 is provided. The anchor includes an upper eyelet 206. The upper eyelet is coupled to the anchor adjacent to the upper end. The anchor includes a lower eyelet 208. The lower eyelet is coupled to the anchor adjacent to the lower end. The driving mechanisms include a first retractable leash 218. The first retractable leash has a first cord 220. The first cord is coupled to the upper eyelet. In this manner the anchor may be lowered. The driving mechanisms include a second retractable leash 222. The second retractable leash has a second cord 224. The second cord is coupled to the lower eyelet. In this manner the anchor may be raised. The cords further include pulleys 226, 228. The pulleys are provided on the movable plate adjacent to the anchor. In this manner the cords are guided.

Resilient fingers 230 are provided. The resilient fingers are secured to the movable plate. In this manner the leashes may be removably received.

Figure 10:
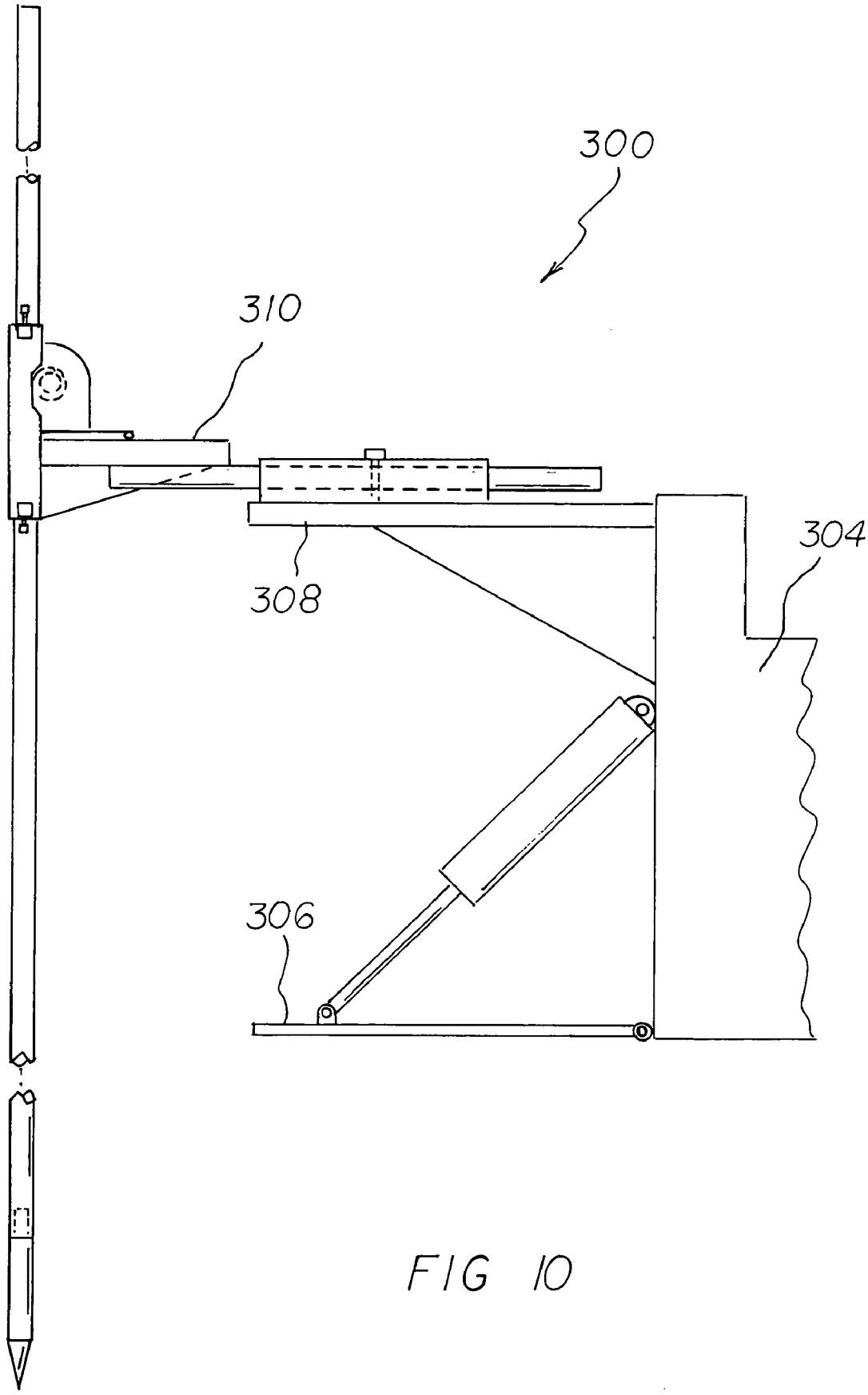
FIG. 10 is a side elevational view of a shallow water anchor system constructed in accordance with a final alternate embodiment of the invention.

A fixed plate 232 is provided. The fixed plate is in an inverted L-shaped configuration. A movable plate 234 is provided. The movable plate is in sliding contact with the fixed plate. The plates include apertures 236, 238. The apertures are provided through the plates. Bolts 240 are provided. The bolts extend through the apertures for securement purposes. The system is adjustable and portable and thus adapted to be attached and removed essentially any boat of essentially any size, Reference is now made to the embodiment of FIG. 10. A boat 304 is provided. The boat has a laterally extending trim tab 306. A fixed plate 308 is provided. The fixed plate extends laterally from the boat and above the trim tab. A movable plate 310 is provided. The fixed plate and the movable plate are of a sufficient length to position the vertical collar and anchor during operation and use. The fixed plate and movable plate are laterally offset from the trim tab. The trim tab is located between the anchor and the boat.

Preferred materials for the anchor include fiberglass and aircraft aluminum and plastic resins.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shallow water anchor system comprising:

a rod-shaped anchor having lower and upper ends and a central extent;

a fixed plate and a movable plate with adjustment mechanisms coupling the plates, the movable plate having an exterior end with a vertical collar slidably receiving the central extent of the anchor;

driving mechanisms for selectively raising and lowering the anchor; and a control assembly operatively coupled with respect to the driving mechanisms;

wherein the adjustment mechanisms include an adjustable coupling assembly between a support surface and the central extent of the anchor, the coupling assembly including the fixed plate with bolts attaching the fixed plate to a support surface, the fixed plate having parallel horizontal tubes, the coupling assembly also including the movable plate, the movable plate having an interior end with parallel horizontal rods reciprocable within the tubes and with apertures through the rods and tubes and with pins through the apertures for fixedly positioning the movable plate with respect to the fixed plate and a boat, the movable plate having an exterior end with a vertical collar slidably receiving the central extent of the anchor for moving the anchor between raised and lowered orientations, the collar having an upper end and a lower end.

2. A shallow water anchor system comprising:

a rod-shaped anchor having lower and upper ends and a central extent;

a fixed plate and a movable plate with adjustment mechanisms coupling the plates, the movable plate having an exterior end with a vertical collar slidably receiving the central extent of the anchor;

driving mechanisms for selectively raising and lowering the anchor; and a control assembly operatively coupled with respect to the driving mechanisms;

wherein the control assembly is operatively coupled with the motor, the coupling assembly including an upper limit switch secured to the upper end of the collar with an upper finger normally in contact with the anchor to close a circuit to the motor, the upper finger adapted to switch when the upper end of the anchor passes below the finger for stopping the motor and precluding the anchor from passing beyond the collar, the coupling assembly including a lower limit switch secured to the lower end of the collar with a lower finger normally in contact with the anchor to close a circuit to the motor, the lower finger adapted to switch when the lower end of the anchor passes above the lower finger for stopping the motor and precluding the anchor from passing above the collar, the coupling assembly including a supplemental switch secured between the motor and the movable plate to close a circuit to the motor, the supplemental switch adapted to open when the lower end of the anchor hits a rigid surface with the motor running to effectively lift the motor and open the switch for stopping the motor.

3. A shallow water anchor system comprising:

a rod-shaped anchor having lower and upper ends and a central extent;

a fixed plate and a movable plate with adjustment mechanisms coupling the plates, the movable plate having an exterior end with a vertical collar slidably receiving the central extent of the anchor;

driving mechanisms for selectively raising and lowering the anchor; and a control assembly operatively coupled with respect to the driving mechanisms;

wherein the anchor includes a plurality of stackable cylindrical sections adapted to be contracted by stacking the sections and extended by unstacking the sections; and wherein the driving mechanisms include a weight in the lower end of the anchor for lowering the anchor and a cable for raising the anchor, the cable including an operator controlled motor with a spool, the cable having an upper end secured to the spool and a lower end extending through the anchor and attached adjacent to the lower end of the anchor, the motor and spool adapted to wind up the cable to lift the anchor and to pay out the cable to lower the anchor, control being through the operator and the cable and motor.

4. A shallow water anchor system comprising:

a rod-shaped anchor having lower and upper ends and a central extent;

a fixed plate and a movable plate with adjustment mechanisms coupling the plates, the movable plate having an exterior end with a vertical collar slidably receiving the central extent of the anchor;

driving mechanisms for selectively raising and lowering the anchor; and a control assembly operatively coupled with respect to the driving mechanisms;

wherein the anchor includes an upper eyelet coupled to the anchor adjacent to the upper end and a lower eyelet coupled to the anchor adjacent to the lower end, and wherein the driving mechanisms include a first retractable leash with a first cord coupled to the upper eyelet for lowering the anchor and a second retractable leash with a second cord coupled to the lower eyelet for raising the anchor, the cords further including pulleys on the movable plate adjacent to the anchor for guiding the cords.

5. The system as set forth in claim 4 and further including resilient fingers secured to the movable plate for removably receiving the leashes.

6. A shallow water anchor system for automatically moving a rod-shaped anchor between a lowered orientation for operation and use and a raised orientation for transportation and storage, all in a safe, convenient and economical manner comprising, in combination:

a boat having a periphery with a horizontal support surface;

a rod-shaped anchor having a pointed lower end below and a free upper end above with a cylindrically shaped central extent between the upper and lower ends, the lower end formed with threads receiving threads of a replaceable point for allowing the replacement of the point as a function of the surface being penetrated by the anchor;

an adjustable coupling assembly between the support surface and the central extent of the anchor, the coupling assembly including a fixed plate with bolts attaching the fixed plate to the support surface, the fixed plate having parallel horizontal tubes, the coupling assembly also including a movable plate, the movable plate having an interior end with parallel horizontal rods reciprocable within the tubes and with apertures through the rods and tubes and with pins through the apertures for fixedly positioning the movable plate with respect to the fixed plate and the boat, the movable plate having an exterior end with a vertical collar slidably receiving the central extent of the anchor for moving the anchor between raised and lowered orientations, the collar having an upper end and a lower end;

driving mechanisms for selectively raising and lowering the anchor, the driving mechanisms including a motor pivotably mounted on the movable plate and a battery for powering the motor and a line to a hand held controller for controlling the motor, central extent of the anchor having a linear gear and the motor having a rotatable worm gear co-operable with the linear gear whereby powering the motor and rotating the worm gear in a first direction will raise the linear gear and anchor and whereby powering the motor and rotating the worm gear in a second direction will lower the linear gear and anchor;

a control assembly operatively coupled with the motor, the coupling assembly including an upper limit switch secured to the upper end of the collar with an upper finger normally in contact with the anchor to close a circuit to the motor, the upper finger adapted to switch when the upper end of the anchor passes below the finger for stopping the motor and precluding the anchor from passing beyond the collar, the coupling assembly including a lower limit switch secured to the lower end of the collar with a lower finger normally in contact with the anchor to close a circuit to the motor, the lower finger adapted to switch when the lower end of the anchor passes above the lower finger for stopping the motor and precluding the anchor from passing above the collar, the coupling assembly including a supplemental switch secured between the motor and the movable plate to close a circuit to the motor, the supplemental switch adapted to open when the lower end of the anchor hits a rigid surface with the motor running to effectively lift the motor and open the switch for stopping the motor.

* * * * *